United States Patent [19]

Elkas

[11] 3,949,508

[45] Apr. 13, 1976

[54] FIRING MECHANISM

[75] Inventor: Louis Elkas, Agawam, Mass.

[73] Assignee: Emhart Corporation, Farmington, Conn.

[22] Filed: June 10, 1974

[21] Appl. No.: 478,083

[52] U.S. Cl. ..... 42/69 B; 42/70 D; 42/70 F

[51] Int. Cl.[2] ..... F41C 19/00; F41C 17/00

[58] Field of Search ..... 42/69 B, 69 R, 70 R, 70 D, 42/70 F, 41, 16

[56] References Cited

UNITED STATES PATENTS

| | | | |
|---|---|---|---|
| 2,079,039 | 5/1937 | Razee | 42/69 B |
| 2,418,946 | 4/1947 | Loomis | 42/16 |
| 2,675,638 | 4/1954 | Crittendon | 42/69 B |
| 3,079,718 | 3/1963 | Allyn | 42/69 B |

*Primary Examiner*—Charles T. Jordan

*Attorney, Agent, or Firm*—Chapin, Neal and Dempsey

[57] ABSTRACT

A firing mechanism for a gun having a safety movable to a position which blocks the firing movement of the sear. The elements of the mechanism are generally coplanar and include a hammer pivotable in one direction to fire the gun and in the opposite direction for interengagement with the sear which holds the hammer in a cocked position. The hammer is also rectilinearly movable relative to its pivot point whereby the hammer may be moved into cocked interengagement with the sear while movement of the sear is blocked by the safety.

6 Claims, 6 Drawing Figures

Fig. 1.
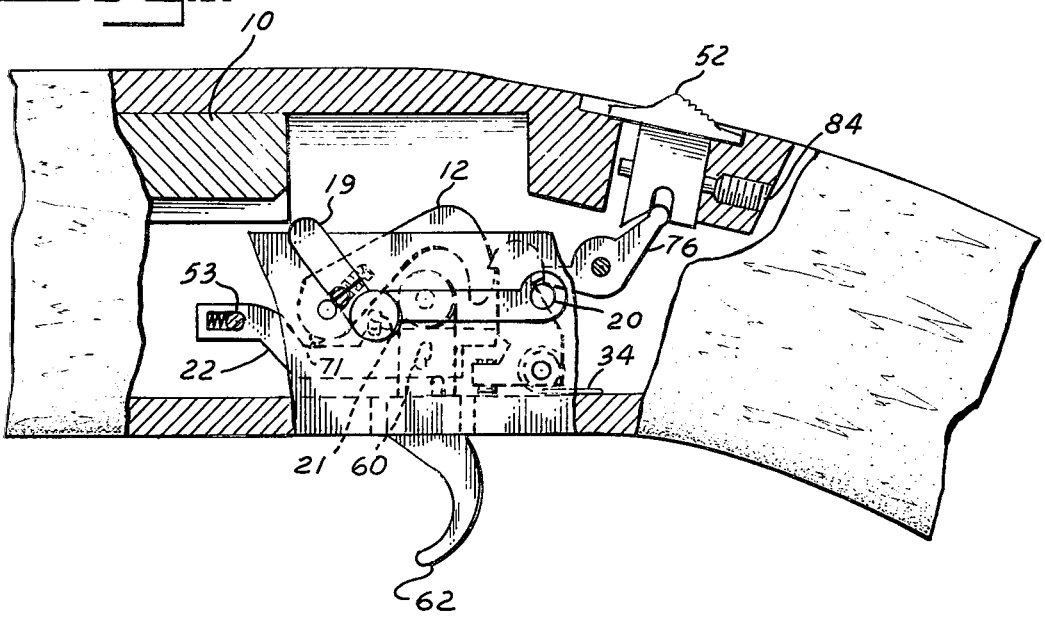
Fig. 2.
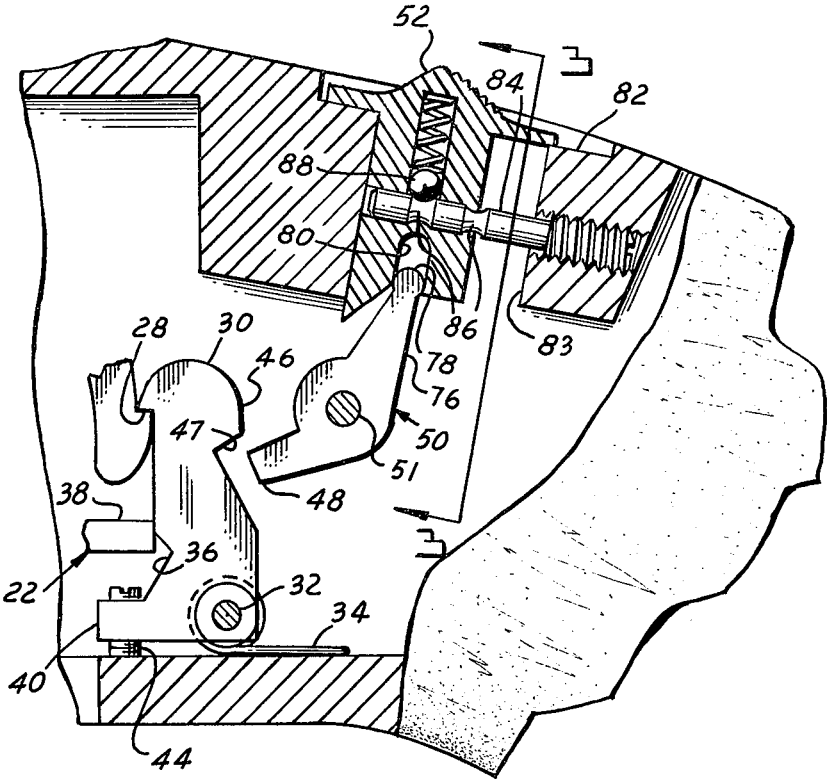
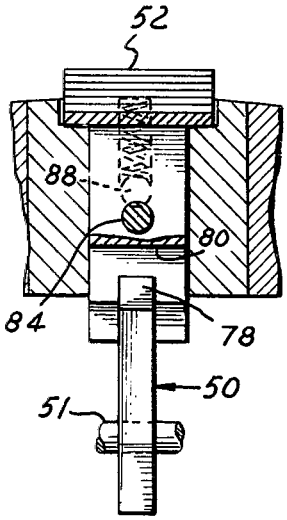
Fig. 3.

Fig. 4.
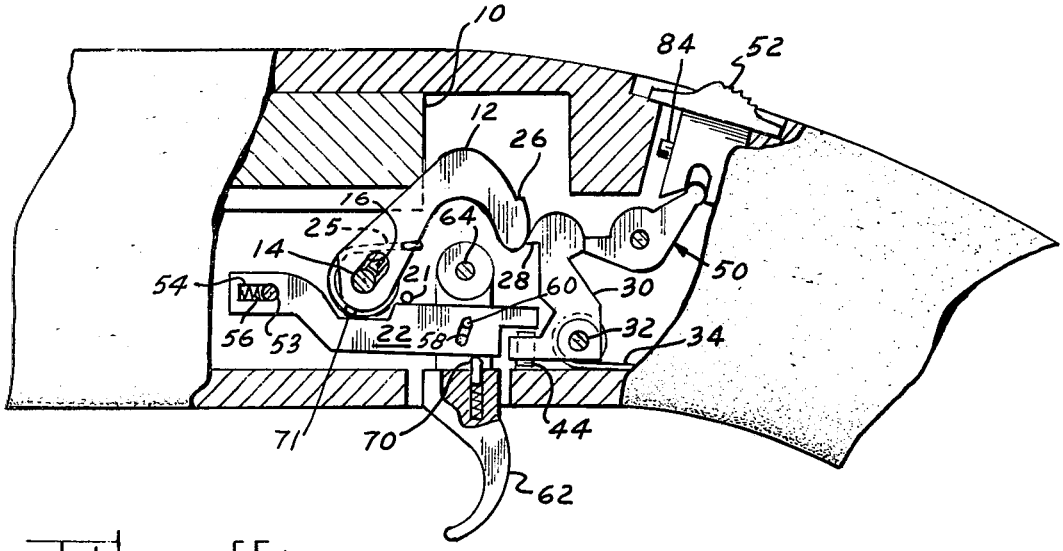
Fig. 5.
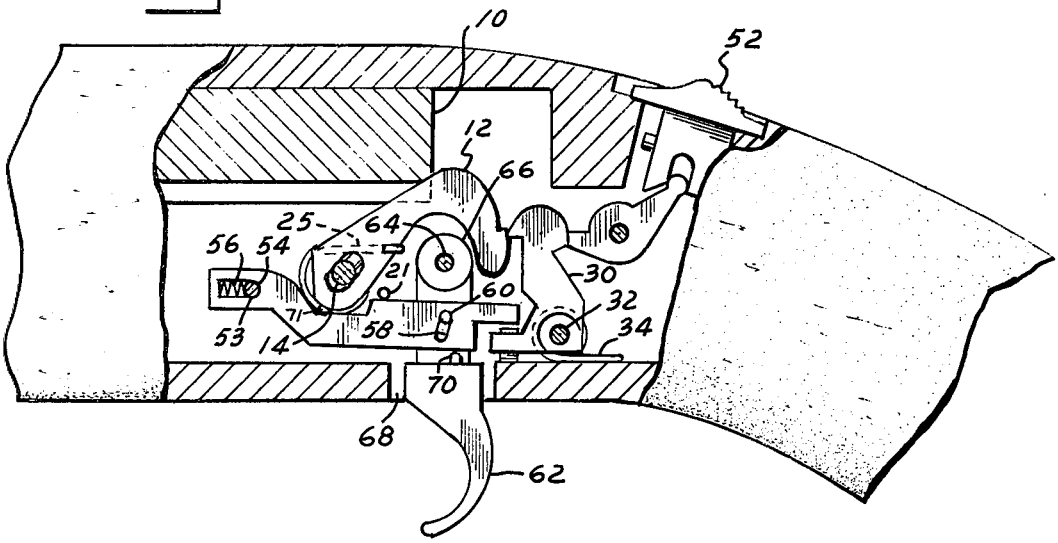
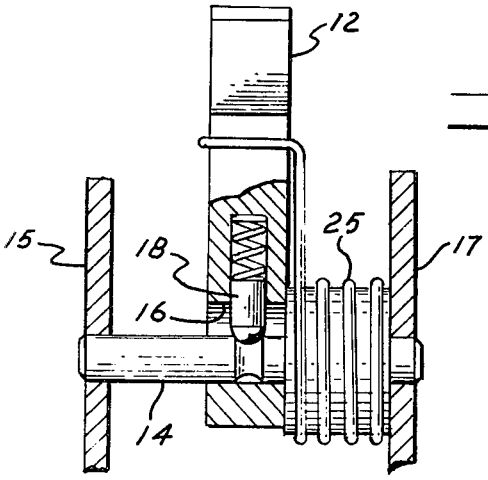
Fig. 6.

FIRING MECHANISM

BACKGROUND

The purpose of this invention is to provide a novel firing mechanism operable in generally a given plane with a compact profile particularly in the vertical and transverse directions. Notwithstanding this compact arrangement, the mechanism is universally adaptable to various types of actions and is effective in operation.

The principal object of this invention is to provide an improved firing mechanism compact in size and effective in operation.

Another object of this invention is to provide a firing mechanism of the above type which has a positive acting safety to positively block the firing movement of the mechanism.

A further object of this invention is to provide an improved firing mechanism in which a safety is movable to a position to block the firing of the mechanism, and which includes mounting means to prevent damage to the elements of the mechanism by cocking movement of the gun when the safety is in its blocking position.

The above and other objects and advantages of this invention will be more readily apparent from the following description and with reference to the accompanying drawings, in which:

FIG. 1 is an elevational view partly in section showing a firing mechanism embodying this invention;

FIG. 2 is an enlarged elevational view showing a portion of the mechanism of FIG. 1 with other parts shown in cross section;

FIG. 3 is a section taken along line 3—3 of FIG. 2;

FIGS. 4 and 5 are elevational views similar to FIG. 1 showing the elements of the mechanism in different operative relationships; and FIG. 6 is an enlarged view illustrating the mounting arrangement of the hammer of the mechanism.

Referring in detail to the drawings, in FIG. 1 is shown a portion of a gun in which a bolt 10 is slidable forward and rearward by any suitable means such as blow back in a semi-automatic gun or by a lever or pump action. When moved rearwardly, as shown in FIG. 4, the bolt 10 engages the forward edge of a pivotable hammer 12 to rotate the hammer toward its cocked position, as shown in FIG. 1. The hammer is pivotable about a pin 14 supported by the spaced sidewalls 15 and 17 (FIG. 6) of the housing of the firing mechanism. The pin 14 extends transversely through an elongated slot 16 which is elongated in a direction radially of the path of rotation of the hammer whereby the hammer is movable linearly relative to its pivot pin 14, as will hereinafter be described. A spring loaded plunger 18 urges the hammer outwardly so the pin 14 is normally positioned in the lower end portion of the slot. The plunger fits into a groove in the pin 14 and thus serves to retain hammer pin 14 when fire control is removed from the gun.

A disconnector 19 (FIG. 1) is pivotable about a pin 20 and includes a transversely extending pin 21 disposed to engage the upper surface of a connector bar 22. The disconnector 19 includes an upwardly extending forward portion which is oriented to lie in the path of travel of the bolt 10 so the disconnector will be deflected downwardly whenever the bolt is retracted from its breech closing position. Thus the disconnector pin 21 will prevent the connector bar 22 from moving upwardly to a position which will enable the firing of the gun.

A torsion spring 25 urges the hammer 12 forwardly. Adjacent its outer end, the hammer 12 is provided with an outwardly facing notch 26 adapted to interengage with a forwardly facing projection 28 adjacent the upper forward end of a sear 30 which is pivotable rearwardly about a pin 32 against torsion spring 34 for releasing the hammer. Spring 34 urges the sear 30 toward its hammer retaining position (FIG. 2).

From the projection 28, the sear extends downwardly in more or less a straight line to recess 36. This recess has a configuration adapted to accommodate the end of a rearwardly extending finger portion 38 of the connector bar 22, whereby when the connector is vertically aligned with the recess, as in FIGS. 4 and 5, the trigger can be moved as in firing without actuating the sear for release of the hammer. Below the recess 36, the sear includes a forwardly extending flange portion 40 (FIG. 2) underlying the finger portion 38 of the connector 22. Stop means shown at 44 is provided and may be threaded to permit adjustment of the extent of the sear and hammer interengagement.

The rear surface of the sear opposite projecton 28 is generally in the form of a flat land 46. A rearwardly facing recess or notch 47 is located immediately below the land 46. The land and the notch 47 cooperate with a leg portion 48 of safety lever 50 for selectively preventing firing movement of the sear 30 by the connector 22. The safety lever 50 is pivoted about pin 51 by means of a thumb actuator 52 disposed to slide forwardly to its "Off" position and rearwardly to its "On" position, as will hereinafter be described. When the safety is "Off", the recess 47 is registered to receive leg 48 of the safety lever 50 enabling rearward pivotable movement of the sear 30 out of engagement with the hammer. When the safety is "On", leg 48 is swung to engage land 46 of the sear and thus provide a positive mechanical block against rearward movement of the sear 30.

The connector 22, which serves to pivot sear 30 for release of the hammer, is pivoted on a pin 53 which extends through a longitudinally elongated slot 54. A coil spring 56 has one end seated against the pin 53 and its other end rests against the forward end of the slot 54, whereby the connector is releasably urged to its forward position, as shown in FIG. 1. As will be appreciated from the following description, the spring 56 serves as a trigger spring. The connector 22 also includes an arcuate slot or cutout 58 through which a pin 60 extends from a leg portion of trigger 62 which is pivoted about a pin 64, extending from the side wall of the housing. The slot 58 is approximately in vertical alignment with the pivot pin 64 and trigger 62. A nylon roller 66 is carried by the pin and serves as a buffer for overdraw of the hammer and as a bearing surface for the longitudinal reciprocable movement of the connector. Rearward movement of the connector 22 compressing spring 56 is responsive to trigger pull and its forward or return movement results from expansion of the coil spring 56. The finger engaging portion of the trigger extends through a slot 68 in the bottom of the housing. The trigger is provided with a shoulder portion from which a spring loaded plunger 70 extends into surface engagement with the underside of the connector 22 slightly rearwardly of the arcuate cutout 58. The plunger 70 urges the connector 22 to its upper position whereby the pin 60 rests against the bottom of the arcuate cutout 58 (FIG. 1) with the rear surface of the connector finger portion 38 disposed at a level which coincides with the flat wall portion of the sear 30 directly above the recess 36. In this position, when the safety is "Off", the sear 30 will be pivoted rearward by operation of the trigger 62 and will result in release of the hammer for firing of the gun. Thus it will be seen that the connector has a linear reciprocal movement for firing the gun in response to trigger pull. The connector is generally disposed in coplanar relationship with disconnector 19, hammer 12, sear 30, safety 50 and trigger 66. The connector is pivotable about the pin 54 so as to be movable to a "safe" position by the disconnector pin 21 and/or the lower end of the hammer with the result that the gun cannot be fired if the bolt is not closed or the hammer is not cocked.

In operation, when the trigger 62, carrying pin 60, is moved as in firing of the gun, the connector 22 is moved rearwardly in the plane of trigger movement thereby compressing spring 56. The finger portion 38 of the connector engages the sear 30 above the recess 36 and deflects the sear about its pivot 32. This causes the sear projection 28 to release from the notch 26 of the hammer 12 which is thereupon swung forcefully forward by the hammer spring 25. Movement of the sear and hammer also takes place in the same plane as the trigger and connector movement.

As the hammer pivots forwardly, its lower end portion, which may be provided with a "Nylon" or "Teflon" projection 71, wipes against the upper surface of the U-shaped cutout of the connector and deflects the connector downwardly whereby its finger portion 38 registers with the recess 36 of the sear 30. So long as the hammer remains uncocked, the connector is inoperable to deflect the sear in response to trigger operation because the finger 38 remains in alignment with the recess 36. It will be recognized that the connector is retained in this inoperative position with respect to the sear by the hammer as just described and also by the transverse pin 21 carried by the disconnector 19 which keeps connector 22 depressed by sensing the position of the bolt. Only when the bolt is forward and the hammer is latched in cocked condition will the trigger pin 70 urge the connector upwardly whereby its finger portion 38 is above recess 36 in position for actuation of the sear 30.

Safety lever 50 also disposed for movement in generally the same plane as the other elements of the firing mechanism, includes the leg portion 48 and an arm portion 76 which extends upwardly from the pivot pin 51. The safety lever terminates in an enlarged head portion 78 received in a downwardly opening slot 80 (FIG. 2) formed in the underside of a knurled flange or slide member 52. The slide is slidably fitted in a recess 82 in the receiver and a skirt or body portion extends downwardly from the bottom of the flange into a cutout 83 in the receiver. The safety is retained in place by a grooved pin 84 which has a threaded outer end portion screw fitted into a threaded bore formed in the receiver. The inner end portion of the pin 84 is provided with a pair of axially spaced, circumferential grooves 86 shaped to receive the outer portion of a spring loaded ball 88. The outer surface of the ball rides upon the upper surface of the rod and together with grooves 86 form detent means for releasably retaining the safety slide in its forward or "Off" position, as shown in FIG. 2, or its "On" or return position shown in FIG. 4. The tension of the coil spring urges the ball outwardly and slide 52 upwardly, whereby the latter slides easily back and forth in recess 82 during operation of the safety for selectively preventing firing release of the hammer by sear 30.

As previously described, the hammer 12 is pivotable about the pin 14, best seen in FIG. 6. The pin extends through the elongated slot 16 and the spring loaded plunger 18 normally urges the hammer outwardly so the pivot pin is normally seated at the bottom end of the elongated slot 16, as in FIGS. 4 and 6, whereby its sear engaging notch 26 swings along an arc about a radius of curvature from the pin 14. In the event the safety lever is in its "On" position, as shown in FIG. 5, with the leg portion 48 thereof engaged with the land 46 of the sear, the sear is blocked against rearward movement. Under such circumstances, were it not for the construction embodying this invention, if the bolt 10 were operated so as to pivot the hammer 12 rearwardly, as seen in FIG. 5, damage could result to either the hammer, sear or safety mechanism. In accordance with this invention the hammer is provided with a "floating" pivotal arrangement so that the radius of curvature defining the arc along which the sear engaging notch 26 moves will be reduced as the outer end portion of the hammer engages the projection 28 of the sear. The hammer is bodily displaced away from the abutting portions of the hammer and sear thereby causing plunger 18 to compress its coacting coil spring, whereby the hammer rides downwardly on its pivot pin 14 permitting the hammer to be cocked without damage to any of the abutting portion of the firing mechanism. Once the projection 28 of the sear has snapped into position in the notch 26 of the hammer, the spring loaded plunger 18 will return the hammer to its outer position, as shown in FIG. 6.

Having thus described the invention, what is claimed is:

1. Firing mechanism for a gun comprising a receiver, a trigger, a pivotal hammer, a sear releasably engageable with said hammer for retaining the same in cocked position and for releasing said hammer for firing the gun in response to trigger actuation, a safety movable to and from a position for blocking firing movement of said sear, said hammer being pivotable so that its sear engaging portion moves along an arc having a given radius of curvature, said hammer being rectilinearly movable to reduce said radius when the hammer being cocked engages said sear which is blocked by said safety, whereby the hammer may be swung into cocked engagement with the sear when the safety is positioned to block movement of said sear.

2. Firing mechanism as set forth in claim 1 in which said hammer and sear are each provided with oppositely facing interengaging means, said hammer being pivotable about a pin disposed through a slot in said hammer elongated in a direction radially extending from said pin and spring means urging said pin toward the inner end of said slot.

3. Firing mechanism as set forth in claim 1 and including a linearly movable connector, said safety being pivotable for movement in generally coplanar relationship with said sear, hammer and connector, said safety including a portion linearly slidable on said receiver and a leg portion disposed to engage said sear for preventing firing movement thereof, said safety being urged outwardly of said receiver by a spring loaded ball.

4. Firing mechanism as set forth in claim 3 in which said connector is linearly movable to pivot said sear for firing movement thereof, said connector also being pivotable in response to pivotable movement of said hammer, said connector and hammer being adapted to enable said firing movement of the sear only when the hammer is cocked.

5. Firing mechanism as set forth in claim 4 in which said connector, hammer and sear are disposed in generally coplanar relationship, said trigger having means for imparting linear movement to said connector toward said sear for firing movement thereof, said sear having a recess disposed for accommodating the connector without sear actuation when the hammer is not cocked and for engagement with the connector when the hammer is cocked.

6. Firing mechanism as set forth in claim 5 further comprising a disconnector having a portion disposed to sense the position of the bolt of said gun and having means positioned to pivot said connector for non-engagement with the sear when the bolt is retracted, said hammer also having means to pivot said connector to a position for said non-engagement with said sear.

* * * * *